United States Patent [19]

Thomas

[11] Patent Number: 4,480,623

[45] Date of Patent: Nov. 6, 1984

[54] LIQUID FUEL INJECTION PUMP

[75] Inventor: Gerald S. Thomas, Gloucester, England

[73] Assignee: Lucas Industries Public Limited Company, Birmingham, England

[21] Appl. No.: 545,673

[22] Filed: Oct. 26, 1983

[30] Foreign Application Priority Data

Nov. 5, 1982 [GB] United Kingdom ..... 8231661

[51] Int. Cl.[3] ..... F01P 9/02

[52] U.S. Cl. ..... 123/514; 123/41.31; 123/41.33; 123/503; 417/228

[58] Field of Search ..... 123/196 AB, DIG. 2, 123/514, 516, 41.31, 41.33, 41.34, 41.42, 196 W, 196 R; 184/104 B, 6.28; 417/228, 372; 165/51

[56] References Cited

U.S. PATENT DOCUMENTS 1,966,223 7/1934 Sass ..... 123/41.31
2,175,450 10/1939 Thege ..... 123/41.31
3,612,012 10/1971 Dreisin ..... 123/41.31
3,945,353 3/1976 Dreisin ..... 123/41.33
4,393,844 7/1983 Skinner ..... 123/516

FOREIGN PATENT DOCUMENTS 322016 7/1957 Switzerland ..... 123/41.31

*Primary Examiner*—Charles J. Myhre
*Assistant Examiner*—Carl Stuart Miller

[57] ABSTRACT

A liquid fuel injection pump includes a reciprocable pumping plunger located in a bore formed in a pump barrel. The barrel is located in a pump body. The bore has first groove for collecting fuel leaking from the pumping chamber defined by the plunger and bore, a second groove through which lubricating oil can be delivered to the working clearance between the plunger and the bore. In order to prevent fuel contaminating the lubricating oil a third groove is provided between the first and second grooves. The third groove is connected to an outlet through which contaminated lubricating oil can flow to a drain.

3 Claims, 1 Drawing Figure

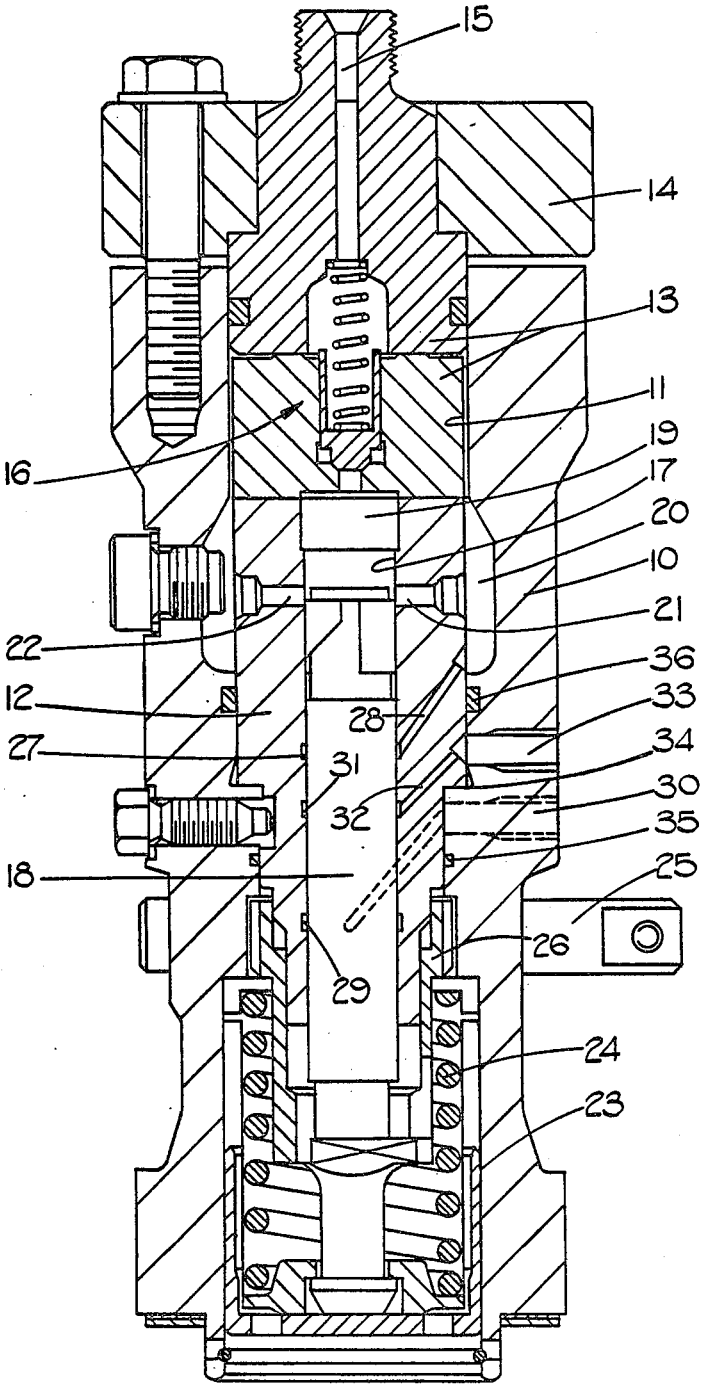
15
14
13
11
19
17
20
10
21
36
33
34
30
35
25
26
24
23
16
22
12
27
18
28
31
32
29

LIQUID FUEL INJECTION PUMP

This invention relates to a liquid fuel injection pump for supplying fuel to an internal combustion engine and of the kind comprising a body defining a stepped bore, a stepped pump barrel located in said bore, a pumping plunger slidable in the bore and extending from one end thereof, a fuel supply gallery defined between the barrel and the body, a filling port in the barrel, said filling port opening into the bore at a position to be covered by the plunger during an injection stroke thereof, the filling port communicating with the fuel supply gallery, a first groove formed in the wall of said bore, said first groove communicating with said fuel supply gallery and acting to collect fuel at high pressure leaking along the working clearance between the wall of the bore and the plunger, a second groove formed in the wall of the bore, said second groove being axially spaced from the first groove between said first groove and said one end of the bore, and passage means in the barrel and body connecting the second groove with a lubricating oil inlet on the body, said lubricating oil inlet, in use, being connected to a source of lubricating oil under pressure to ensure lubrication of the plunger and the wall of the bore.

With such an arrangement it is possible for fuel to be forced along the working clearance between the wall of the bore and the plunger and to mix with the lubricating oil. The lubricating oil thereby becomes contaminated with fuel, thereby reducing its ability to provide adequate lubrication. Such fuel flow can take place due to momentary increases in the pressure of fuel in the gallery, as for example, when fuel is spilled from the pumping chamber of the pump into the fuel supply gallery.

The object of the invention is to provide an injection pump of the kind specified in a simple and convenient form.

According to the invention a fuel injection pump of the kind specified comprises a third groove in the wall of the bore, said third groove being positioned between said first and second groove, an outlet in the body and further passage means connecting said outlet with said third groove, said outlet in use being connected to a drain.

An example of a fuel injection pump in accordance with the invention will now be described with reference to the accompanying drawing, which is a sectional side elevation of the pump.

Referring to the drawing the pump comprises a hollow body 10 in which is defined a stepped bore 11. Located in the body is a pump barrel 12 which has a stepped peripheral surface having one step as will be described locating against a step in the bore 11. The pump barrel is retained within the body by its abutment with a split delivery valve housing indicated at 13, the housing being retained in position by a clamp member 14 which is secured by bolts, to the body 10. The delivery valve housing defines a high pressure fuel outlet 15 and it mounts a delivery valve generally indicated at 16.

The pump barrel is provided with a bore 17 and slidable within the bore is a pumping plunger 18. The bore 17 and the pumping plunger 18 define with part of the delivery valve body, a pumping chamber 19 with which the outlet 15 is connected by way of the delivery valve 16.

Defined around the pump barrel, conveniently in the body 10, is a fuel supply gallery 20, which in use is connected to a source of fuel under pressure, and communicating with the gallery is a pair of diametrically disposed ports 21, 22, these ports opening into the bore 17 at a position to be covered by the plunger 18 during inward movement thereof. The port 21 constitutes a filling port through which fuel can flow from the gallery 20 into the pumping chamber when the inner end of the port is uncovered by the plunger. The port 22 serves primarily as a spill port although fuel can also enter the pumping chamber by way of this port. The plunger is provided with a helical control edge which can uncover the spill port, whereby the amount of fueld displaced during inward movement of the pumping plunger can be controlled.

The plunger 18 extends from the end of the bore remote from the delivery valve housing 13 and engages with a tappet, the sleeve portion 23 of which is shown in the drawing, this being slidable in an enlarged portion of the bore 11. The tappet is biased outwardly by a coiled compression spring 24 and the tappet has a base wall which is engaged by the end of the plunger 18. The tappet in use will be engaged either by a cam or a rocker which itself is actuated by a cam, the cams being driven by the associated engine, so that the plunger 18 is actuated in timed relationship with the engine.

The angular setting of the plunger 18 is controlled by a rack bar 25 which has teeth coupled to a sleeve 26 angularly movable about the barrel 12 and connected to the plunger 18 by means of a peg on the plunger which is slidable within a slot formed in the sleeve.

The operation of the pump is well known in the art. When the plunger is moved inwardly and when the ports 21 and 22 have been covered by the plunger, the pressure of fuel in the chamber 19 increases to the point where the delivery valve is opened and fuel flows through the outlet 15 to an injection nozzle of the associated engine until the helical control edge on the plunger uncovers the spill port.

The fuel under pressure in the chamber 19 will leak along the working clearance defined between the plunger and the wall of the bore 17. This leakage fuel is retained by a first circumferential groove 27 which is formed in the wall of the bore 17 and this communicates directly by way of a passage 28, with the gallery 20. Most of the fuel therefore which leaks along the working clearance will be collected by the groove 27 and returned to the fuel supply gallery 20.

When the pump is used to supply heavy fuel which may require to be heated before it can be pumped, it is necessary to lubricate the plunger and the bore and this is achieved by means of a second groove 29 which is spaced from the groove 27 and is located between the groove 27 and the end of the bore 17 remote from the delivery valve housing. The groove 29 is connected to a lubricating oil inlet 30 which is formed in the body 10 and in use, this is connected to the engine lubrication system so that the lubricating oil of the engine provides the required lubrication between the plunger and the wall of the bore. Even though the groove 27 is provided to return leakage fuel, it is found that some of the fuel can flow towards the groove 29 and hence mix with the lubricating oil. This can arise due to momentary increases in the pressure of fuel within the fuel supply gallery as fuel is spilled through the port 22 to terminate delivery of fuel.

In order to prevent such mixing of the fuel and lubricating oil, a third groove 31 is provided in the wall of the bore, the third groove being positioned between the first and second grooves. This groove is connected by a passage 32 to an outlet 33 formed in the body and connected in use to a drain. The liquid collecting in the groove 31 and hence flowing through the outlet 33, will be a mixture of fuel and oil and will be collected in some suitable container and discarded at regular intervals. The chances therefore of the lubricating oil becoming contaminated are minimised.

A problem exists in provided adequate seals between the barrel and the wall of the bore 11 so that lubricating oil and the contaminated oil can flow from and to the lubricating oil inlet 30 and the outlet 33 respectively.

In the normal form of pump the step on the barrel and the step in the wall of the bore 11 would be disposed just below, the fuel supply gallery. If this construction, however, is adopted it becomes necessary to establish a circumferential seal between the barrel and the wall of the bore 11 between the inlet 30 and outlet 33. Normally such a seal would be established using an elastomeric seal member which would be located in a groove. Such seal members are perfectly adequate at low temperatures but where the pump is for supplying fuel which has to be heated, fairly rapid deterioration of the seal member can take place. It would be possible therefore in the event of failure of the seal for fuel to contaminate the lubricating oil. It is therefore a feature of the pump that the steps in the pump barrel and the wall of the bore 11 which provide the axial location of the barrel within the body, are positioned between the inlet 30 and outlet 33. The junction of these two steps is shown at 34. Metal-to-metal contact between the barrel and the body is therefore established and there is no possibility of transfer of fuel along the clearance so that it could contaminate the lubricating oil. An elastomeric sealing member 35 is provided below the lubricating oil inlet 30 to prevent leakage so far as is possible, of the lubricating oil directly into the space occupied by the tappet. Furthermore, an elastomeric sealing member 36 is provided to establish a seal between the body 10 and the pump barrel at a position between the gallery and the outlet 33. Although the use of such a seal at this point is not entirely satisfactory, it does act to at least minimize leakage of fuel to the outlet 33 and even if the seal does fail there will still be no contamination of the lubricating oil.

I claim:

1. A liquid fuel injection pump for supplying fuel to an internal combustion engine comprising a body defining a stepped bore, a pump barrel located in said bore, a pumping plunger slidable in the bore and extending from one end thereof, a fuel supply gallery defined between the barrel and the body, a filling port in the barrel, said filling port opening into the bore at a position to be covered by the plunger during an injection stroke thereof, the filling port communicating with the fuel supply gallery, a first groove formed in the wall of said bore, said first groove communicating with said fuel supply gallery and acting to collect fuel at high pressure leaking along the working clearance between the wall of the bore and the plunger, a second groove formed in the wall of the bore, said second groove being axially spaced from the first groove between said first groove and said one end of the bore, passage means in the barrel and body connecting the second groove with a lubricating oil inlet on the body, said lubricating oil inlet, in use, being connected to a source of lubricating oil under pressure to ensure lubrication of the plunger and the wall of the bore, a third groove in the wall of the bore, said third groove being positioned between said first and second grooves, an outlet in the body and further passage means connecting said outlet with said third groove, said outlet in use being connected to a drain.

2. A pump according to claim 1 in which the pump barrel and the bore define co-operating steps at a position between said lubricating oil inlet and the outlet connected to the third groove, said steps cooperating to define a seal between the inlet and outlet.

3. A pump according to claim 2 including elastomeric sealing means disposed between the wall of the bore and said barrel, said sealing means being located between the fuel supply gallery and said outlet.

* * * * *